US012044498B2

(12) United States Patent
Taylor et al.

(10) Patent No.: US 12,044,498 B2
(45) **Date of Patent: *Jul. 23, 2024**

(54) FIREARM MAGAZINE WELL EXTENSION AND RETENTION LOCK, AND METHOD OF USE

(71) Applicant: Taylor Freelance, LLC, Bellingham, WA (US)

(72) Inventors: Robin Taylor, Bellingham, WA (US); Michael Fox, Bellingham, WA (US)

(73) Assignee: Taylor Freelance, LLC, Bellingham, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/731,864

(22) Filed: Apr. 28, 2022

(65) Prior Publication Data

US 2022/0268541 A1 Aug. 25, 2022

Related U.S. Application Data

(63) Continuation of application No. 16/773,929, filed on Jan. 27, 2020, now Pat. No. 11,320,218.

(60) Provisional application No. 62/796,917, filed on Jan. 25, 2019.

(51) Int. Cl.
*F41A 3/66* (2006.01)
*F41A 9/64* (2006.01)

(52) U.S. Cl.
CPC . *F41A 3/66* (2013.01); *F41A 9/64* (2013.01)

(58) Field of Classification Search
CPC ..... F41A 3/66; F41A 9/64
USPC ..... 42/18, 22
See application file for complete search history.

(56) References Cited

U.S. PATENT DOCUMENTS

| | | | | |
|---|---|---|---|---|
| 4,520,585 | A * | 6/1985 | Barrett | F41C 23/10 42/7 |
| 7,743,542 | B1 * | 6/2010 | Novak | F41A 9/24 42/49.02 |
| 8,127,480 | B1 * | 3/2012 | McManus | F41A 9/61 42/49.02 |
| 9,217,617 | B1 * | 12/2015 | Mapes | F41A 17/38 |
| 11,320,218 | B2 * | 5/2022 | Taylor | F41A 9/64 |
| 2010/0154275 | A1 * | 6/2010 | Faifer | F41C 23/16 29/592 |
| 2012/0073176 | A1 * | 3/2012 | McManus | F41A 9/82 42/6 |
| 2013/0104440 | A1 * | 5/2013 | Addis | F41A 17/38 42/90 |
| 2016/0273857 | A1 * | 9/2016 | Pettit | F41A 3/66 |
| 2017/0138685 | A1 * | 5/2017 | Beasley | F41A 9/71 |

(Continued)

*Primary Examiner* — Bret Hayes
(74) *Attorney, Agent, or Firm* — FisherBroyles, LLP

(57) ABSTRACT

A magwell extension is provided and configured to assist a user in inserting a cartridge magazine into the magwell of a firearm. The extension includes a hollow body enclosed on four sides and open at opposite ends. A coupling face defines a first of the ends and includes a pair of rails configured to engage the rim of the magwell. A stop rail extending from the coupling face lies perpendicular to the pair of rails. A locking element is configured to be coupled to the body with a portion extending from the first opening and beyond a plane defined by the coupling face. The locking element is configured to bias the rim of the magwell into secure engagement with the stop rail.

10 Claims, 4 Drawing Sheets

(56) References Cited

U.S. PATENT DOCUMENTS

| | | | | |
|---|---|---|---|---|
| 2018/0347929 | A1* | 12/2018 | Hsu | F41A 9/71 |
| 2020/0025472 | A1* | 1/2020 | Landis | F41A 9/65 |

* cited by examiner

FIREARM MAGAZINE WELL EXTENSION AND RETENTION LOCK, AND METHOD OF USE

RELATED CASES

This application is a continuation of U.S. patent application Ser. No. 16/773,929, filed Jan. 27, 2020, which claims the benefit of U.S. Provisional App. No. 62/716,917, filed Jan. 25, 2019, the disclosures of each of which are incorporated herein by reference in their entirety.

BACKGROUND

Field of the Invention

The present disclosure relates generally to a magazine well extension for assisting in the insertion of a cartridge magazine into a firearm, and, more particularly, to a retention lock mechanism for coupling the extension to the firearm.

Related Art

FIG. 1 is a side elevation view of an AR-15 rifle 100, according to known art. The rifle 100 includes upper and lower receivers 102, 104, a butt stock 106, and a barrel 108. The lower receiver 104 includes a pistol grip 110, a trigger assembly 112, and a magazine port 114. Another term commonly used for the magazine port 114 is magazine well, or magwell-which is the term that will be used hereafter. The magwell 114 is an opening in the lower receiver 104 configured to receive cartridge magazines 116, which are preloaded with ammunition cartridges.

The AR-15 100 is a semi-automatic firearm. While details vary from one manufacturer to another, and from one type of firearm to another, the general operation of the rifle is similar to that of other semi-automatic rifles and handguns, and has some features that are also found on many automatic firearms. Many rifles and handguns are subject to rough handling during operation and transport, and so are designed to tolerate some abuse without loss of function. For example, the magwell 114 typically includes a thickened ridge or rim 118 extending around a mouth of the magwell to provide additional strength and stiffness, so as to prevent damage or distortion of the mouth if the rifle is dropped, or strikes against an obstacle, etc.

In operation, the rifle 100 fires cartridges from the magazine 116, which are arranged in a spring-loaded stack so that as each cartridge is chambered by the loading mechanism of the rifle 100, the next cartridge is moved to the top of the magazine. When a chambered cartridge is fired, a small portion of the energy produced is used to eject the spent shell and chamber the next cartridge, until all of the cartridges are fired. The user activates a magazine release mechanism to eject the empty magazine 116, and inserts a loaded magazine into the magwell 114. A latch mechanism automatically engages and holds the new magazine 116 as it is inserted into the magwell 114.

AR-15 rifles are popular among shooting enthusiasts for many reasons, including their relatively low cost, availability, reliability, and ease of operation. They are frequently the firearm of choice in competitions of marksmanship and speed. Many manufacturers produce aftermarket accessories for use, in particular, by competitive shooters, designed to improve or enhance the operation of the firearm or assist the user in its operation. For example, in some competitions, a user fires at many targets in succession, as fast as possible while maintaining accuracy. This can require multiple reloads, performed very fast and by feel alone as the user maintains visual contact with the next target. As a result, it is not uncommon for a user to strike the rim 118 of the magwell 114 with a magazine 116 while attempting to blindly insert the magazine into the magwell, so that the user must attempt insertion multiple times or, alternatively, move more slowly and deliberately. Of course, this increases the user's time and results in a lower final score.

To reduce this problem, many competitors attach a funnel-shaped extension to the rim of the magwell, effectively enlarging the mouth of the magwell so as to guide a magazine into the magwell proper. Hereafter, the terms magwell extension or simply extension will be used. Other terms are also sometimes used to refer to this element, including, for example, magwellfunnel, magazine guide, etc.

SUMMARY OF THE INVENTION

According to an embodiment, a magwell extension is provided and configured to assist a user in inserting a cartridge magazine into the magwell of a firearm. The extension includes a hollow body enclosed on four sides and open at opposite ends. A coupling face defines a first of the ends and includes a pair of rails configured to engage the rim of the magwell. A stop rail extending from the coupling face lies perpendicular to the pair of rails. A locking element is configured to be coupled to the body with a portion extending from the first opening and beyond a plane defined by the coupling face. The locking element is configured to bias the rim of the magwell into secure engagement with the stop rail.

According to another embodiment, a magwell extension is provided, including a body, enclosed on four sides by a sidewall and having first and second mouths opening on respective opposite ends of the body into a hollow interior defined by the inner surface of the sidewall. A coupling face defines an end of the body in which the first mouth is formed, and first and second rails extend parallel to each other from first and second edges of the coupling face. A stop rail also extends from the coupling face along a third edge, and lies perpendicular to the first and second rails. The magwell extension also includes a locking element having first and second ends, the a first end having a first end face, and a first side face extending on one side of the locking element between the first and second ends thereof. The locking element is configured to be coupled to the body adjacent to the inner surface of the sidewall with a portion of the locking element, including the first end face, extending from the first mouth of the body and beyond a plane defined by the coupling face of the body. A fastener is configured to bias the first end face of the locking element toward the stop rail. In use, the end face of the locking element biases the rim of a magwell against the stop rail.

According to an embodiment, the magwell extension includes a recess formed in the inner surface of the body, shaped and configured to receive a portion of the locking element therein. A fastening aperture extends through the sidewall from the outer surface to the recess, and the the locking element includes a threaded aperture sized and positioned such that when the locking element is positioned in the recess the threaded aperture aligns with the fastening aperture. The fastener is configured to extend through the fastening aperture and engage the threaded aperture of the locking element.

According to an embodiment, a portion of the first side face of the locking element near the second end thereof is raised relative to the remaining portion of the first side face, so that when the locking element is drawn into the recess by the fastener, the raised portion contacts an inner face of the recess, while the first end face of the locking element contacts an inner face of the magwell.

According to an embodiment, the first end face of the locking element is configured to engage a chamfered surface of the inner face of the magwell, and has an angle, relative to an adjacent surface of the locking element, that is approximately supplementary to an angle of the chamfered surface, relative to the inner surface of the magwell.

According to an embodiment, when the first mouth of the body is positioned against the magwell of a selected firearm, the inner face, around at least three sides of the body, has an angle and position that approximately corresponds to the angle and position of the chamfer formed around the mouth of the magazine well, such that the inner face forms an extension of the chamfer.

According to an embodiment, firearm system is provided, including a firearm having a magazine well, and a magazine well extension coupled over a mouth of the magazine well and configured to assist in guiding a cartridge magazine into the magazine well. The magazine well extension has a hollow body, enclosed on four sides and open at first and second ends, with a stop rail extending from the first end of the magazine well extension and positioned to contact an outside face of a rim of the mouth of the magazine well. A locking element is also provided, coupled to the magazine well extension and configured to bias the rim of the magazine well against the stop rail of the magazine well extension. The magazine well extension has a recess formed in a sidewall thereof, and the locking element is positioned within the recess and extends beyond a plane defined by the first end of the magazine well extension.

According to an embodiment, the magazine well extension includes first and second side rails extending from respective edges of the first end thereof and configured to engage the rim of the magazine well. The locking element is further configured to bias the first and second side rails into secure engagement with the rim of the magazine well.

According to another embodiment, the locking element is configured to contact an inner face of the magazine well at a first end, while the second end of the locking element has a raised portion configured to contact a surface of the magazine well extension.

According to an embodiment, a method is provided for installing a magazine well extension onto the magazine well of a firearm, and includes sliding the magazine well extension into engagement with a mouth of a the magazine well until a stop rail of the magazine well extension is in contact with a rim of the magazine well. the rim of the magazine well is then biased against the stop rail by coupling a locking element to the magazine well extension.

According to an embodiment, the coupling a locking element to the magazine well extension includes positioning the locking element in a recess formed in the magazine well extension with a surface of the locking element lying substantially flush with an inner surface of the magazine well extension and an end of the locking element extending beyond an end of the magazine well extension.

According to an embodiment, the locking element is coupled to the magazine well extension by engaging a threaded aperture formed in the locking element with a fastener via an aperture that extends through a sidewall of the magazine well extension.

DETAILED DESCRIPTION

The inventors have recognized that many of the known magwell extensions tend to damage surfaces of the magwell to which they are attached, such as, for example, by the use of a set screw that bears against a surface of the magwell. In other cases, it is necessary to partially disassemble and/or modify some features of a rifle, in order to mount an extension, which may be time consuming or otherwise undesirable. Still other known versions have an arrangement in which a user must capture the end of a firearm's magwell between two halves of an extension, which are then coupled together by multiple fasteners. This process can be complicated, particularly if it must be performed under field conditions, as it requires that the user hold the halves in alignment with each other and simultaneously with the end of the magwell while also engaging the fasteners.

In view of the various deficiencies of known designs, the inventors determined to devise a magwell extension that did not require modification to the firearm, would not leave unsightly surface damage, and that could be installed or removed quickly and easily. Each of the embodiments described hereafter fulfills one or more of these goals.

Where terms such as front and back, or forward and rearward, and the like are used herein, they refer broadly to directions corresponding, respectively, to the barrel and stock or butt of a firearm. For example, referring to the rifle 100 of FIG. 2, the magwell 114 might be described as being in front of the trigger assembly 112, and that the rifle can be discharged by pulling the trigger in a rearward direction. Terms such as top, bottom, upper, lower, etc., are used to refer to elements as they or corresponding elements would be oriented if shown in FIG. 2. Directional terms, including those mentioned here, are used for clarity and convenience, and, except where explicitly used therein, do not limit the scope of the claims.

Figure 1:
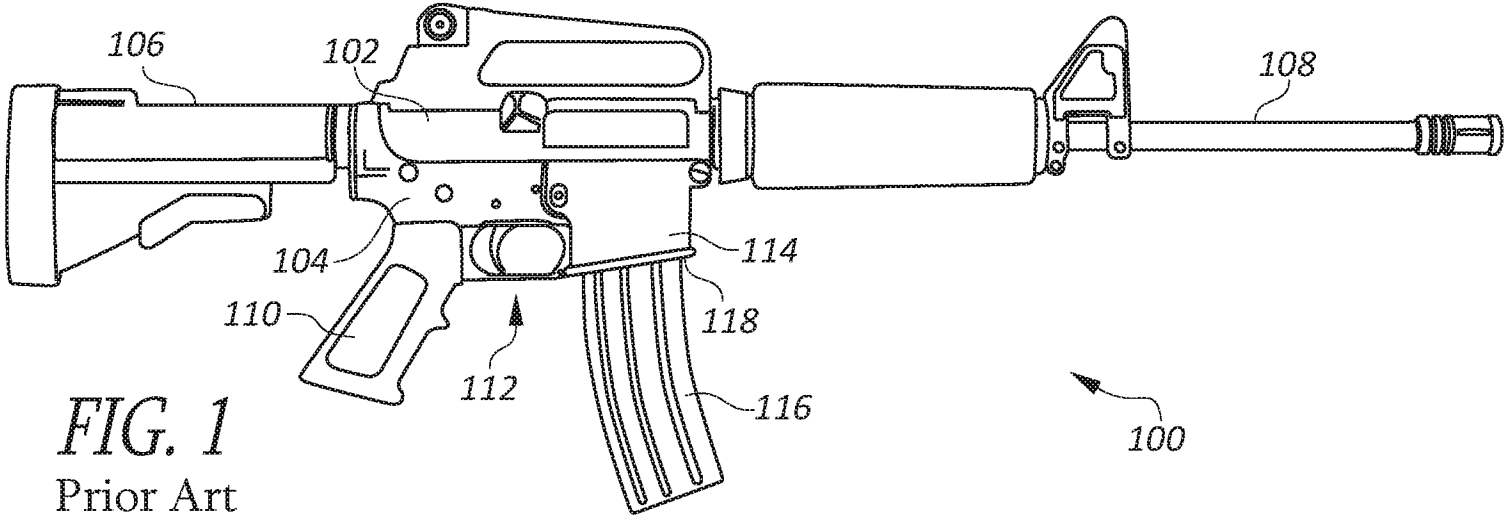
FIG. 1 Prior Art
FIG. 1 is a side elevation of an AR-15 rifle, according to known art.
Figure 2:
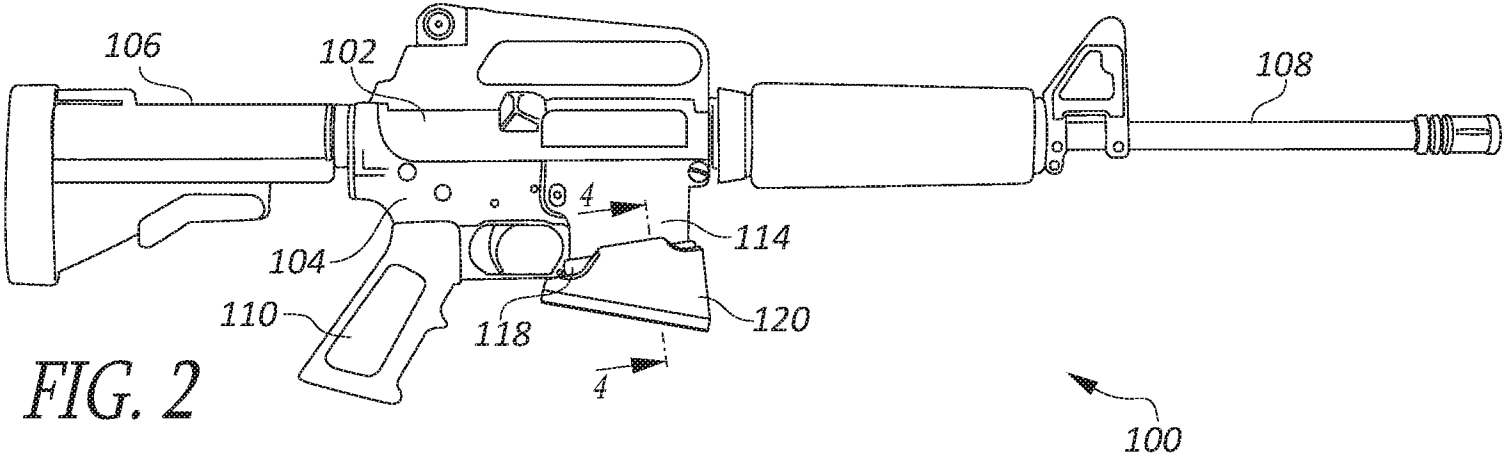
FIG. 2 is a side elevational view of an AR-15 rifle similar to the rifle of FIG. 1, with a magwell extension attached to the magwell of the rifle, according to an embodiment.

FIG. 2 is a side elevation view of an AR-15 rifle 100 similar to the rifle described in the background with reference to FIG. 1, with a magwell extension 120 attached to the magwell 114 of the rifle 100, according to an embodiment. As will be described below with reference to other drawings, the magwell extension 120 is configured to provide an enlarged opening for a user and to guide a magazine into the magwell 114. Additionally, the extension 120 is configured to be easily and securely attachable to the rim 118 of the rifle 100 without modification, or damage, to the rifle.

Figure 3:
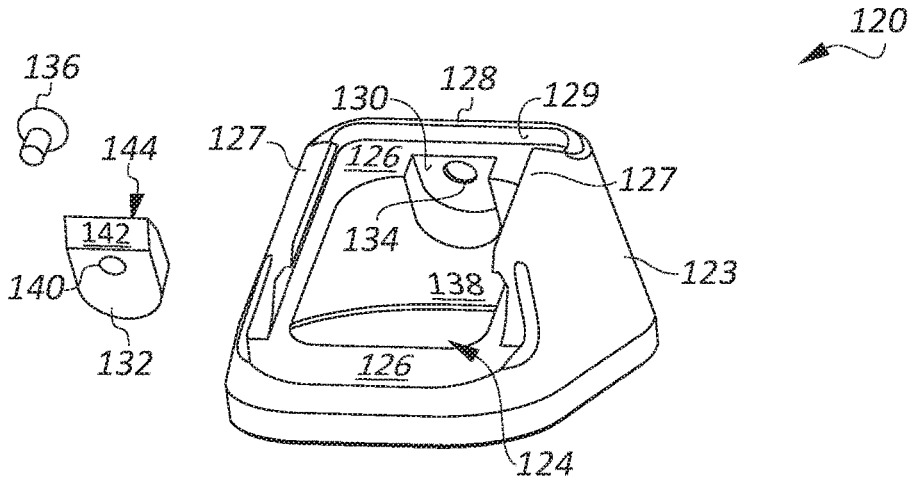
FIG. 3 is a perspective view of the magwell extension of FIG. 2, according to an embodiment.
Figure 4:
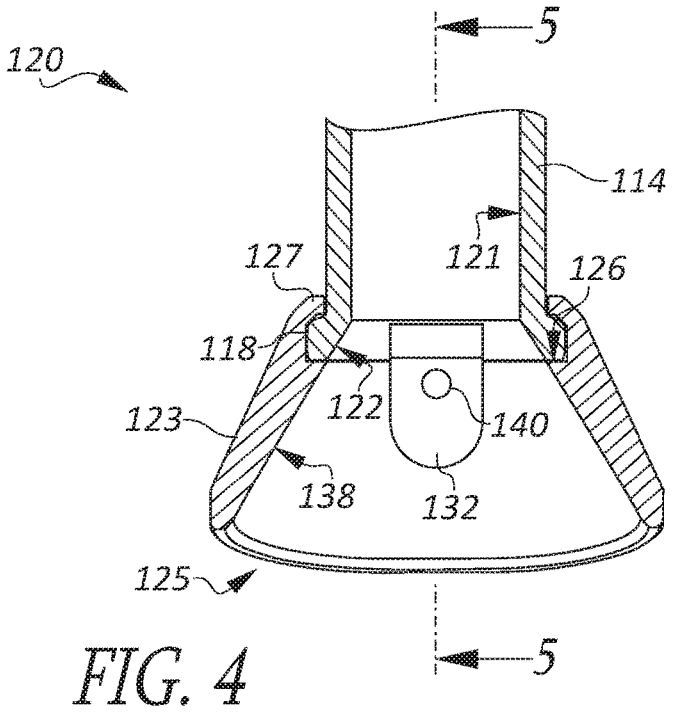
FIG. 4 is a cross-sectional view of the magwell extension and a portion of the magwell of the rifle of FIG. 2, taken in a plane defined in FIG. 2 by lines 4-4.

FIG. 3 is a perspective view of the magwell extension 120, according to an embodiment, and FIG. 4 is a cross-sectional view of the extension 120 coupled to the magwell 114 of the rifle 100, taken in a plane defined in FIG. 2 by lines 4-4. As can be seen in FIG. 4, in the AR-15 example shown in the drawings an inner face 121 of the magwell 114 includes a chamfer 122 that extends around the rim 118 at the mouth of the magwell. This is typical of most AR-15 rifles, and is a common feature of the magwells of many other firearm types as well, although the chamfer varies in size and angle depending upon the manufacturer, the particular model, etc.

The extension 120 includes a generally funnel-shaped, hollow body 123, including an upper mouth 124 with dimensions that correspond to the dimensions of the mouth of the magwell 114, and a larger lower mouth 125. The extension 120 includes a coupling face 126 defining an end of the body 123, and first and second rails 127 that lie parallel with each other and extend from the coupling face. A stop rail 128 with a stop face 129 also extends from the coupling face 126 and lies perpendicular to the first and second rails 127. The extension 120 is configured to engage the rim 118 of the magwell 114 between the coupling face 126 and first and second rails 127. The stop rail 128 and stop face 129 are positioned to contact the rim 118 while the extension is properly positioned on the magwell 114. A recess 130, formed in the body 123 and intersecting the coupling face 126, is sized and configured to receive a locking element 132 and includes an aperture 134 through which a fastener 136-*a* machine screw, in this embodiment-passes to couple the locking element to the extension 120. An interior surface 138 of the extension 120 has an angle that, while installed on a rifle, corresponds generally to the angle of the chamfer 122 around most of the mouth of the magwell 114 of the rifle.

Figure 5:
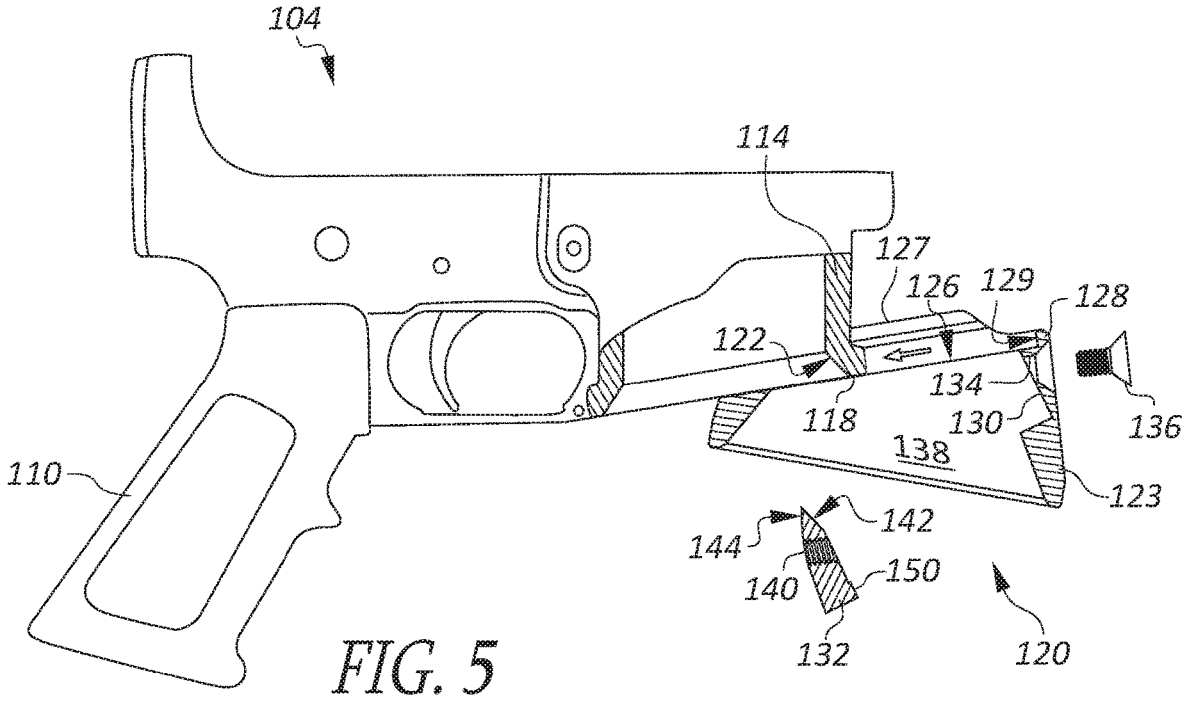
FIGS. 5 and 6 are side elevational views of the lower receiver of an AR-15 rifle with the magwell extension of FIG. 2, with cut-away cross-sectional views of the lower portion of the magwell and the extension along a plane defined in FIG. 4 by lines 5-5, showing the extension at respective stages of installation on the magwell, according to an embodiment.
Figure 6:
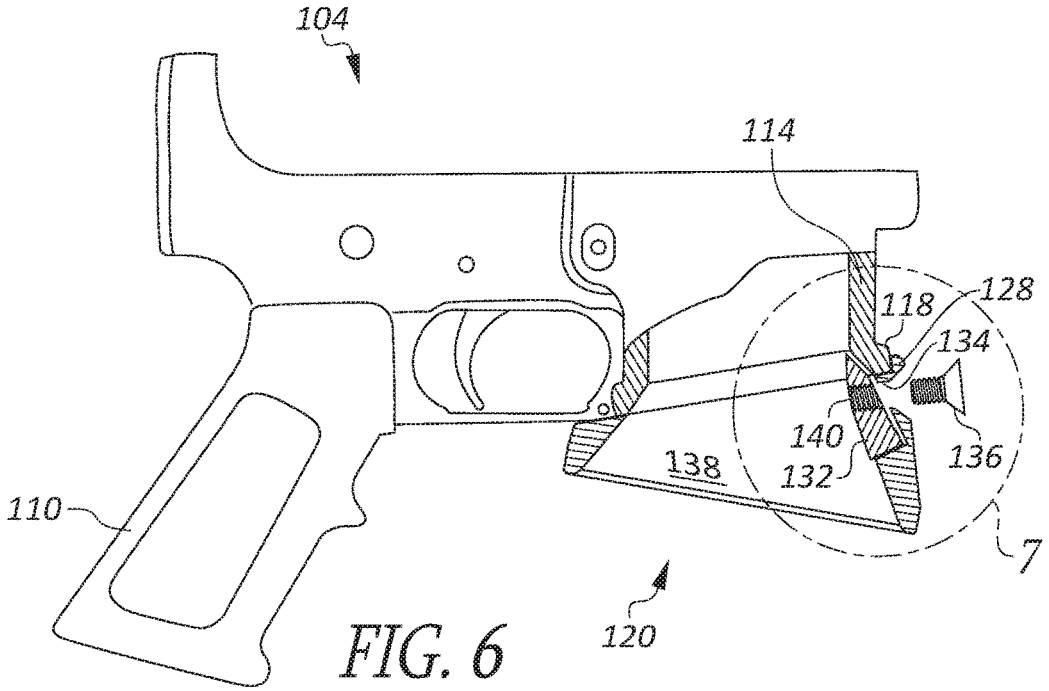
Figure 7:
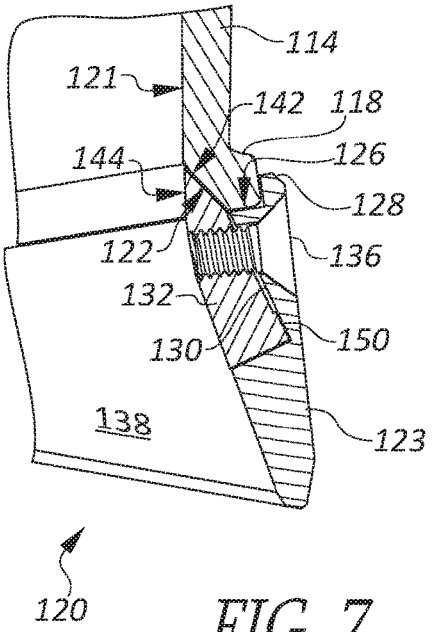
FIG. 7 is a detail of portions of the magwell and the extension of FIGS. 5 and 6, and in the same sectional view, taken from a region indicated in FIG. 6 at 7, and showing the extension installed and secured by a locking element, according to an embodiment.

The locking element 132 includes a threaded aperture 140 configured to receive the fastener 136, and further includes first and second end faces 142, 144 positioned adjacent to each other at one end of the locking element, and a raised heel portion 150 at the opposite end, as shown in FIGS. 5-7. The locking element 132 is shown and described in greater detail below, with reference to FIGS. 5-7.

FIGS. 5 and 6 are cross-sectional side views of the lower receiver 104 of the AR-15 rifle 100 described above, with the magwell extension 120 shown at respective stages of installation on the magwell 114 of the rifle, according to an embodiment. FIG. 7 is a detail of portions of the magwell 114 and the extension 120, shown in the same sectional plane as FIGS. 5 and 6 and taken from a region indicated in FIG. 6 at 7, showing the extension installed and secured by the locking element 132, according to an embodiment.

To install the extension 120, the user positions the extension with the rim 118 of the magwell 114 in contact with the rearmost edge of the coupling face 126, i.e., the edge that will lie closest to the stock of the gun when installed—the rearmost edge of the coupling face is the portion of the coupling face lying closest to the viewer in FIG. 3. The user then slides the extension rearward, as shown in FIG. 5, while keeping the coupling face 126 and the rim 118 in contact, such that the first and second rails 127 engage the upper edges of the rim, and capture the rim between the rails and the coupling face. The user continues to slide the extension rearward until the stop face 129 of the stop rail 128 contacts the rim 118.

As shown in FIG. 6, the user then positions the locking element 132 in the recess 130 with the raised heel portion 150 against the inner face of the recess 130 and the first end face 142 resting against the chamfer 122, and inserts the fastener 136 through the aperture 134 to engage the threaded aperture 140 of the locking element 132.

Turning now to FIG. 7, the user tightens the fastener 136, drawing the locking element 132 tightly into the recess 130 and the first end face 142 of the locking element 132 against the chamfer 122. Because of the raised heel portion 150 of the locking element 132, and the shape and angle of the first end face 142, most of the front of the locking element is prevented from contacting the inner face of the recess 130. As a result, a large part of the force applied by the fastener 136 is applied by the first end face 142 of the locking element 132 against the chamfer 122 of the inner face 121, pressing the rim 118 tightly against the stop face 129. Additionally, because of the relative angles of the first end face 142 of the locking element 132 and the chamfer 122 of the inner face 121, the extension 120 is biased downward against the engagement of the first and second rails 127 with the rim 118, as best shown in FIG. 4. This securely locks the extension 120 onto the magwell 114 and significantly reduces or eliminates any tendency of the extension to rattle or vibrate on the magwell.

The installation process is simplified by several features: (1) the extension 120 slides onto the rim 118 of the magwell 114 and provides a positive stop where the upper mouth 124 of the extension is correctly aligned with the mouth of the magwell, and once positioned, will be held in positioned by gravity if the rifle 100 is oriented with the barrel 108 upward, or can be held in position by light rearward pressure against any of its surfaces; (2) the heel end of the locking element 132 is shaped to fit snuggly into the recess 130, so that it can be correctly positioned simply by placing the locking element into the recess and, with a finger, applying a slight pressure inward and toward the heel end—and because of the engagement of the first end face 142 against the chamfer 122, the same slight pressure can also serve to hold the magwell in the correct position during completion of the process; (3) once the locking element is correctly positioned, the aperture 134 of the magwell 120 aligns with the threaded aperture 140 of the locking element, so that when inserted into the aperture of the magwell, the fastener 136 is guided directly into engagement with the threaded aperture; and (4) the steps are performed sequentially, so the user is not required to perform multiple tasks simultaneously.

The angle of the first end face 142 is selected to correspond to the angle of the chamfer 122 such that when the locking element 132 is installed, the entire surface of the first end face contacts the face of the chamfer 122. This spreads the applied force across the area of the entire surface of the first end face 142, reducing the likelihood that the chamfer 122 will be marred or damaged by the locking element. The second end face 144 of the locking element 132 has an angle that is selected to substantially correspond to the relative angle of the inner face 121 of the magwell 114 so as to lie substantially flush therewith. Additionally, the shapes of the locking element 132 and the recess 130 are selected such that when the locking element is positioned in the recess as shown in FIG. 7, the back surface of the locking element lies substantially flush with the inner surface 138 of the extension 120. This, together with the relationship of the second end face 144 and the inner face 121 of the magwell provides a transition between the extension 120 and the magwell 114, so that when a cartridge magazine strikes the inner surface 138 of the extension during insertion, it can slide smoothly into the magwell without obstruction.

Figure 8:
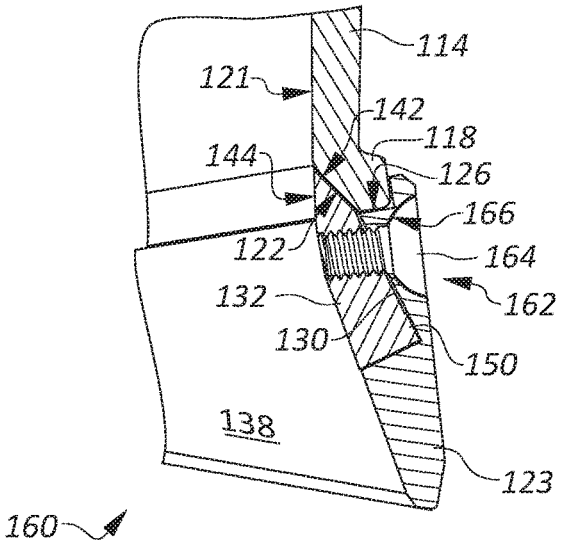
FIG. 8 shows portions of a magwell extension and the magwell of a firearm, according to another embodiment, in a sectional view that is similar in subject and detail to the view of FIG. 7.

FIG. 8 is a sectional view of a portion of a magwell extension 160 and the magwell 114, according to another embodiment. The view and level of detail are similar to those of FIG. 7. Most of the elements shown in the embodiment of FIG. 8 are similar to corresponding elements of the extension 120 described above and are indicated by the same reference numbers, and will therefore not be described in detail. However, the extension 160 includes a fastener 162 that differs slightly. The fastener 162 has a head 164 that is semispherical in shape, while an inner face 166 of the aperture 168 has a corresponding semispherical shape, forming a ball-and-socket-type engagement between the fastener head and the inner face of the aperture. This permits the fastener 162 to rotate slightly within the aperture 168, in turn permitting the locking element 132 to find the broadest contact and distribute the forces applied by the fastener as evenly and broadly as possible, while accommodating slight variations in the angle of the chamfer 122, the first end face 142, etc.

Figure 9:
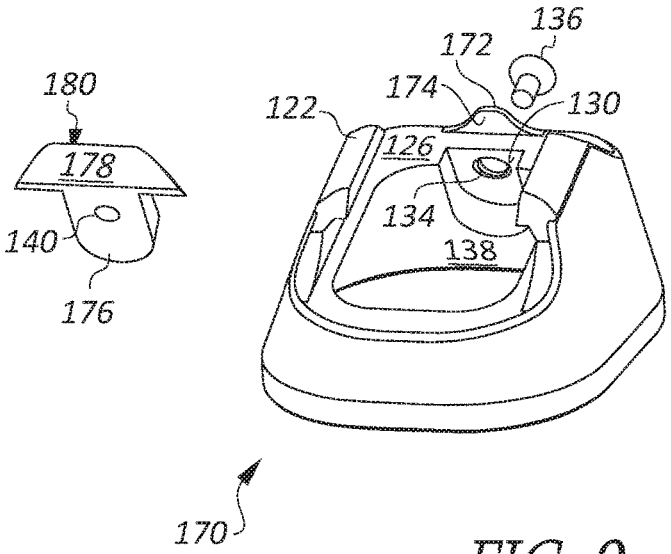
FIG. 9 is a perspective view of a magwell extension, according to another embodiment.

FIG. 9 is a perspective view of a magwell extension 170, according to another embodiment. The extension 170 is similar in most respects to the magwell extension 120, particularly as described with reference to FIG. 3. Accordingly, only those features that distinguish one embodiment from the other will be described in detail. In particular, the extension 170 includes a stop rail 172 and stop face 174 that are substantially narrower than the corresponding elements in previous embodiments. Such differences may be for the purpose of accommodating a feature of one model of firearm that is not present on another, or may be simply a matter of design choice. Additionally, the locking element 176 has a "T" shape, and includes first and second end faces 178, 180 that are wider than the corresponding first and second end faces 142, 144 of the embodiment of FIG. 3. The wider first end face 178 of the locking element 176 tends to distribute the applied force of the fastener 136 across a larger surface area of the chamfer 122 as compared with the previously described locking element 132. This can, for example, compensate for the narrower stop face 174, which might otherwise permit some movement in the magwell extension 170 while in use. Additionally, the wider distribution of the applied force can further reduces the potential for surface damage to the chamfer 122. The second end face 180 of the locking element 176 also provides a broadened transitioning surface across which a misaligned magazine can slide, from the inner face 138 of the extension 170 to the inner face 121 of the magwell.

Other distinguishing features of the extension 170 are not shown or described in detail, such as differences in surface angles and/or dimensions. Such differences may arise, for example, if the extensions 120 and 170 are configured to fit the magwells of rifles that are different models, that are configured to fire different caliber ammunition, and/or that are sold by different manufacturers. As previously noted, there are many manufacturers of rifles and handguns that use magazine-fed ammunition, and that therefore include magwells configured and dimensioned to accommodate the respective cartridge magazines. the inventors contemplate various embodiments adapted to operate with respective ones of many of those rifles and handguns.

Ordinal numbers, e.g., first, second, third, etc., are used in the claims according to conventional claim practice, i.e., for the purpose of clearly distinguishing between claimed elements or features thereof, etc. Ordinal numbers may be assigned arbitrarily, or assigned simply in the order in which elements are introduced. The use of such numbers does not suggest any other relationship, such as order of operation, relative position of such elements, etc. Furthermore, an ordinal number used to refer to an element in a claim should not be assumed to correlate to a number used in the specification to refer to an element of a disclosed embodiment on which that claim reads, nor to numbers used in unrelated claims to designate similar elements or features.

The abstract of the present disclosure is provided as a brief outline of some of the principles of the invention according to one embodiment, but is not intended as a complete or definitive description of any single embodiment thereof, nor should it be relied upon to define terms used in the specification or claims. The abstract does not limit the scope of the claims.

Reference throughout this specification to one embodiment, an embodiment, an alternative embodiment, and other variations, indicates that a particular feature, structure, or characteristic described in connection with the embodiment is included in at least one embodiment of the invention. Thus, phrases such as in one embodiment or according to an embodiment, as used in various places throughout this specification do not necessarily all refer to the same embodiment, nor do they suggest that the features described are limited to any single embodiment. Rather, individual features, structures, or characteristics described with reference to various separate embodiments can be combined in any suitable manner with each other and/or with other known structures to form additional embodiments. The scope of the claims is therefore not limited by particular embodiments set forth herein, but should be construed in a manner consistent with the specification as a whole.

What is claimed is:

1. A magazine well extension, comprising:

a hollow body, enclosed on four sides and open at first and second ends;

a stop rail extending from the first end of the magazine well extension and configured to contact an outside face of a rim of a mouth of a magazine well;

a locking element coupled to the magazine well extension and configured to bias the rim against the stop rail; and a recess formed in a sidewall of the hollow body, wherein the locking element is positioned within the recess and extends beyond a plane defined by the first end of the magazine well extension.

2. The magazine well extension of claim 1, further comprising:

first and second side rails extending from respective edges of the first end thereof and configured to engage the rim of the magazine well, wherein the locking element is configured to bias the first and second side rails into secure engagement with the rim of the magazine well.

3. A magazine well extension, comprising:

a hollow body, enclosed on four sides and open at first and second ends;

a stop rail extending from the first end of the magazine well extension and configured to contact an outside face of a rim of a mouth of a magazine well; and a locking element coupled to the magazine well extension and configured to bias the rim against the stop rail, wherein the locking element is configured to contact an inner face of the magazine well at a first end of the locking element, a second end of the locking element having a raised portion configured to contact a surface of the magazine well extension.

4. A magazine well extension, comprising:

a hollow body, enclosed on four sides and open at first and second ends;

a stop rail extending from the first end of the magazine well extension and configured to contact an outside face of a rim of a mouth of a magazine well; and a locking element coupled to the magazine well extension and configured to bias the rim against the stop rail;

a recess formed in an inner surface of the hollow body and intersecting a coupling face adjacent to the stop rail, the recess being shaped and configured to receive a portion of the locking element therein;

a fastening aperture extending through a sidewall from an outer surface to the recess, wherein the locking element includes a threaded aperture extending therein, sized and positioned such that when the locking element is positioned in the recess, the threaded aperture aligns with the fastening aperture; and a fastener configured to extend through the fastening aperture and engage the threaded aperture of the locking element.

5. The magazine well extension of claim 4, wherein:

a portion of a first side face of the locking element near the second end thereof is raised relative to the remaining portion of the first side face.

6. The magazine well extension of claim 4, wherein:

a first mouth of the hollow body has a size and shape that corresponds to a mouth of a magazine well of a selected firearm, the first and second side rails being spaced apart a distance that approximately corresponds to an outside dimension of a rim of the magazine well of the selected firearm, and the locking element is configured such that when the first mouth of the hollow body is positioned against the mouth of the selected firearm, and the locking element is positioned in the recess with the threaded aperture engaged by the fastener, an angle of the first end of the locking element corresponds to an angle of a chamfer formed around the mouth of the magazine well.

7. The magazine well extension of claim 6, wherein:

when the first mouth of the body is positioned against the mouth of the selected firearm with the first, second, and third rails engaging corresponding surfaces of the rim of the selected firearm, the inner face, around at least three sides of the body, has an angle and position that approximately corresponds to the angle and position of the chamfer formed around the mouth of the magazine well, such that the inner face forms an extension of the chamfer.

8. The magazine well extension of claim 5, wherein:

the locking element comprises a second side face on a side opposite the first side face, and a second end face at the first end of the locking element;

the first end of the locking element shares an edge with the first side face and shares an opposite edge with the second end face; and the second end face of the locking element shares an edge with the first end face and shares an opposite edge with the second side face.

9. A method of installation of a magazine well extension, comprising:

sliding a magazine well extension into engagement with a mouth of a magazine well of a firearm with a stop rail of the magazine well extension in contact with a rim of the magazine well;

biasing the rim of the magazine well against the stop rail by coupling a locking element to the magazine well extension, wherein coupling the locking element to the magazine well extension comprises engaging a threaded aperture formed in the locking element with a fastener via an aperture that extends through a sidewall of the magazine well extension.

10. The method of claim 9, wherein coupling the locking element to the magazine well extension comprises positioning the locking element in a recess formed in the magazine well extension.

* * * * *